US005375568A

United States Patent [19]

Manolis et al.

[11] Patent Number: 5,375,568

[45] Date of Patent: Dec. 27, 1994

[54] MULTIVALVE INTERNAL COMBUSTION ENGINE

[76] Inventors: John Manolis, P.O. Box 380, New York, N.Y. 10028-0004; Pete Manolis, P.O. Box 291, New York, N.Y. 10028

[21] Appl. No.: 271,079

[22] Filed: Jul. 6, 1994

[51] Int. Cl.[5] ..... F01L 1/26

[52] U.S. Cl. ..... 123/90.22; 123/90.4; 123/432

[58] Field of Search ..... 123/432, 90.4, 90.48, 123/90.22

[56] References Cited

U.S. PATENT DOCUMENTS

| | | | |
|---|---|---|---|
| 1,223,762 | 4/1917 | Bugatti | 123/90.22 |
| 1,321,580 | 11/1919 | Winton | 123/90.22 |
| 1,410,787 | 3/1922 | Wells | 123/90.22 |
| 3,400,693 | 9/1968 | Siding | 123/90.4 |
| 4,256,068 | 3/1981 | Irimajiri et al. | 123/432 |
| 4,922,867 | 5/1990 | Mathews | 123/90.4 |
| 5,016,592 | 5/1991 | Onodera | 123/432 |
| 5,236,274 | 8/1993 | Taniguchi | 123/90.4 |

FOREIGN PATENT DOCUMENTS

| | | | |
|---|---|---|---|
| 484035 | 8/1917 | France | 123/90.22 |
| 517723 | 5/1921 | France | 123/90.22 |

*Primary Examiner*—E. Rollins Cross
*Assistant Examiner*—Erick Solis

[57] ABSTRACT

A multivalve internal combustion engine which has a cluster valve system, said system comprises a cam on a camshaft, a valve stem with a valve spring, a cluster valve lever mounted on a lower end of said valve stem, said cluster valve lever has a plurality of holes and a plurality of valves. Said valves are inserted into said holes of said cluster valve lever respectively, and secured by mated nuts that are tightened by application of torque to make the cluster valve system to operate as one single valve.

4 Claims, 1 Drawing Sheet

MULTIVALVE INTERNAL COMBUSTION ENGINE

BACKGROUND OF THE INVENTION

The present invention relates to a multivalve system for an internal combustion engine and more particularly to a practical and simple cluster valve system.

The cluster valve system comprises a plurality of valves operated by a single valve stem, a single valve spring and a single cam on a camshaft. As the camshaft rotates, the cam compresses the valve spring and forces the valve stem and the cluster valve lever to move downward to operate all cluster valves at the same time.

Said cluster valve system further comprises a cluster valve lever mounted on a lower end of said valve stem, said cluster valve lever has holes, each valve is inserted into a hole respectively and secured on said cluster valve lever by a mated nut that is tightened by application of torque.

Conventional internal combustion engines use two valves per cylinder, as opposed to the present invention, such conventional valve systems restrict the amount of air-fuel that enters the cylinder during the intake stroke and does not allow the exhaust to leave as rapidly during the exhaust stroke, thereby decreasing efficiency and power of the engine at high speed.

Conventional internal combustion engines also possess many other drawbacks and disadvantages.

The cluster valve system of the present invention is cheap to manufacture and to maintain. The cluster valve system will eliminate many moving parts of the valve system of a conventional engine, which can make an internal combustion engine smaller, lighter and more powerful and efficient.

The cluster valve system will operate more than eight valves per cylinder, more than four intake valves operated by one intake valve stem and more than four exhaust valves operated by one exhaust valve stem.

SUMMARY OF THE INVENTION

It is an object of the present invention to provide a multivalve internal combustion engine.

It is another object of the present invention to provide a cluster valve system, which comprises a valve stem, a cluster valve lever with the cluster valves attached thereto.

DETAILED DESCRIPTION OF PREFERRED EMBODIMENT

Figure 1:
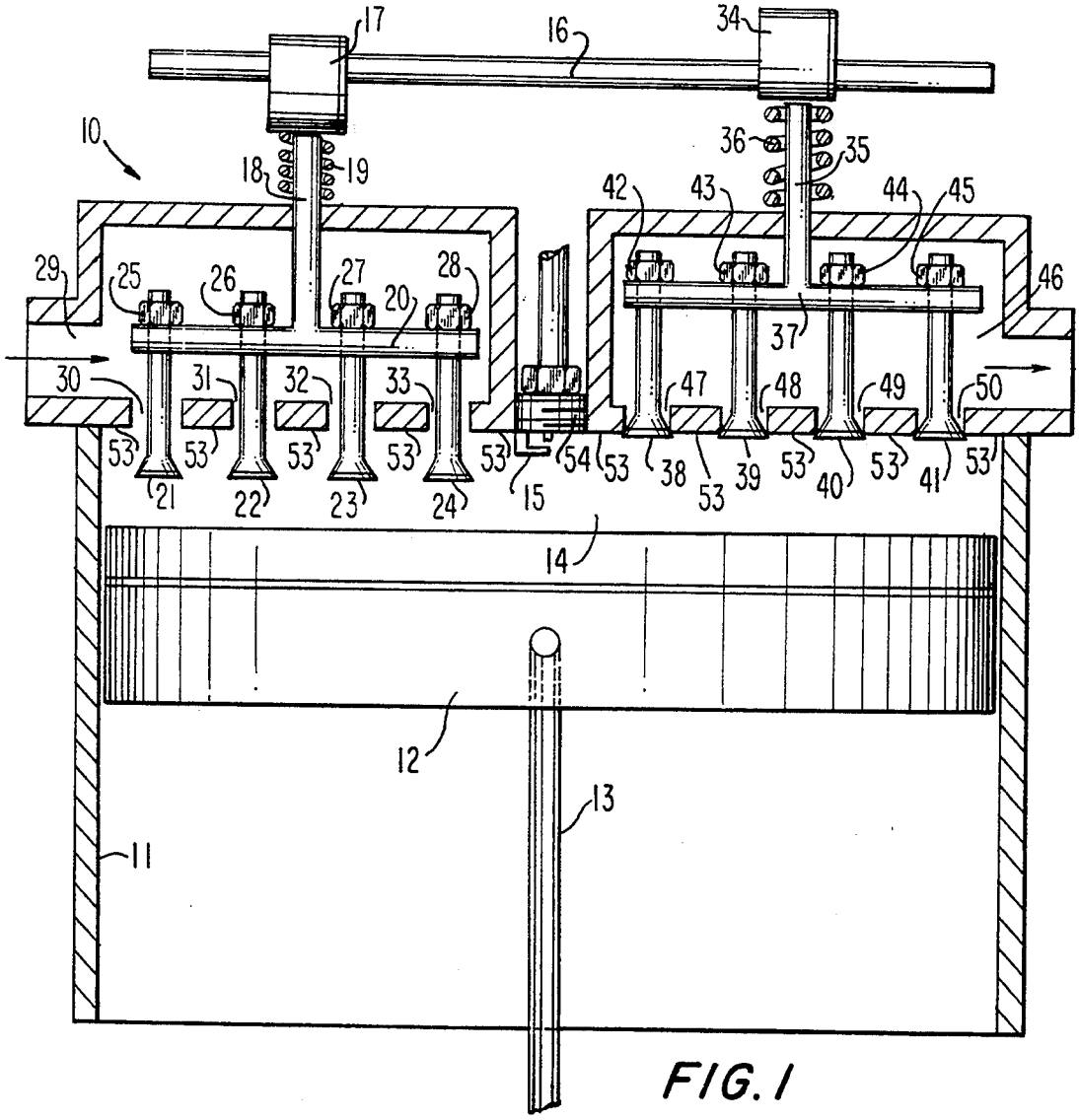
FIG. 1 is a schematic longitudinal view of an internal combustion engine employing the cluster valve system of the present invention, during the intake stroke.

Referring now more particularly to the accompanying drawings, wherein like reference numerals designate similar parts throughout the various views, FIG. 1 illustrates an exemplary internal combustion engine (designated generally by reference number 10) in which the present invention will have a particularly advantageous utility. It will be understood that the present invention is not limited to use with a V-type gasolinepowered engine, but may be used in connection with various internal combustion engines such as diesel engines, etc. Since familiarity with internal combustion engines is assumed, operation of engine 10 will be briefly described only to the extent believed necessary to facilitate a complete understanding of the present invention.

Engine 10 depicts an internal combustion engine employing the cluster valve system of the present invention, and comprising a cylinder 11, a piston 12, a connecting rod 13, a combustion chamber 14 and a spark plug 15. A camshaft 16 with cam 17, which is in operative relation to a valve stem 18 having a valve spring 19. A cluster valve lever 20 is mounted on the lower end of stem 18, cluster valves 21, 22, 23 and 24 are attached on said cluster valve lever 20 and secured by nuts 25, 26, 27 and 28 respectively. The intake manifold 29 is communicating with an air-fuel source and has ports 30, 31, 32 and 33, said ports allow communication between the intake manifold 29 and the combustion chamber 14.

During the operation of the engine 10 the camshaft 16 rotates, the cam 17 pushes the valve stem 18 attached to cluster valve lever 20 downward, thereby compressing valve spring 19. The cluster valves 21, 22, 23 and 24 attached to cluster valve lever 20 move downward and open the intake ports 30, 31, 32 and 33 respectively.

Air-fuel flows therethrough from the intake manifold 29 into the combustion chamber 14.

During the exhaust stroke the camshaft 16 rotates and the cam 34 forces the valve stem 35 and the cluster valve lever 37 to move downward, thereby compressing the valve spring 36. The cluster valves 38, 39, 40 and 41 attached to the cluster valve lever 20 move downward and open the ports 47, 38, 49 and 50 respectively, the exhaust gases flow therethrough from the combustion chamber 14 to the exhaust manifold 46.

Figure 2:
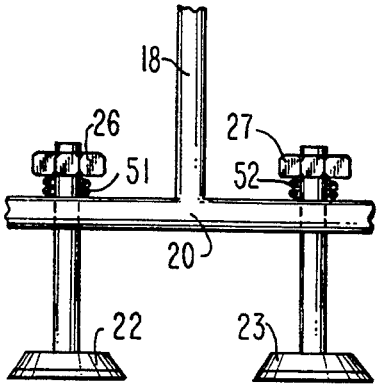
FIG. 2 is a partial side view of the cluster valve system of the present invention employing a cluster valve spring.

FIG. 2 is a partial sectional view of the intake cluster valve system showing the valve stem 18, intake valves 22 and 23, the cluster valve lever 20, the nuts 26 and 27 and the cluster valve springs 51 and 52 between the cluster valve lever 20 and nuts 26 and 27 respectively. During the normal operation of the engine 10 the cluster valve spring 51 and 52 are inoperative. The cluster valve springs 51 and 52 allow the cluster valve lever 20 to become more flexible when the valve spring 19 forces the valve stem 18 and the cluster valve lever 20 to move upward and close the cluster valves 21, 22, 23 and 24. The valve spring 18 has greater force than the cluster valve springs 51 and 52.

Figure 3:
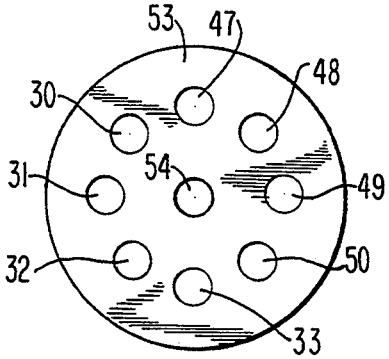
FIG. 3 is a bottom plane view of the cylinder head with valves and spark plug removed.

FIG. 3 is a bottom plane view of the cylinder head 53 with the valves 21, 22, 23, 24, 38, 39, 40, 41 and spark plug 15 removed.

The center port 54 is for the spark plug 15. The ports 30, 31, 32 and 33 are for the intake cluster valves 21, 22, 23 and 24 respectively. The ports 47, 48, 49 and 50 are for the exhaust cluster valves 38, 39, 40 and 41 respectively.

It should be readily apparent from the foregoing description that the described embodiments of the invention provide a relatively simple yet effective cluster valve system and porting arrangement for a plurality intake valve engine and a plurality exhaust valve engine wherein the performance will be maximized throughout the entire engine speed and load ranges and there will be good air-fuel mixture distribution under all running conditions of the combustion engine.

Of course, the foregoing description is that of preferred embodiments of the invention and various changes and modifications may be made without departing from the spirit and scope of the invention.

What is claimed is:

1. A multivalve internal combustion engine having a cluster valve system, said cluster valve system comprising:

a. a cam on a camshaft;

b. a valve stem with a valve spring;

c. a cluster valve lever mounted on a lower end of said valve stem;

d. said cluster valve lever having a plurality of holes therein and;

e. a plurality of cluster valves inserted into said plurality of holes of said cluster valve lever.

2. A multivalve internal combustion engine according to claim 1, wherein said plurality of valves are inserted into said plurality of holes of said cluster valve lever respectively and secured by mated nuts that are tightened by application of torque to make said cluster valves to operate as one single valve.

3. A multivalve internal combustion engine according to claim 1, wherein said cluster valve lever operates a plurality of valves, such that when said camshaft rotates, said cam forces said valve stem and said cluster valve lever to move downward and open all said cluster valves at the same time.

4. A multivalve internal combustion engine according to claim 1, wherein a cluster valve spring is mounted on said cluster valve lever between said cluster valve lever and a nut of said cluster valve lever, said valve spring having greater force than said cluster valve spring.

* * * * *